US006435463B1

(12) United States Patent
Zezza

(10) Patent No.: US 6,435,463 B1
(45) Date of Patent: Aug. 20, 2002

(54) SYSTEM AND METHOD FOR SUSPENDING A TREE

(76) Inventor: Nevin A. Zezza, 9867 W. County Rd. D, Exeland, WI (US) 54835

( * ) Notice: Subject to any disclaimer, the term of this patent is extended or adjusted under 35 U.S.C. 154(b) by 0 days.

(21) Appl. No.: 09/498,539

(22) Filed: Feb. 4, 2000

Related U.S. Application Data

(60) Provisional application No. 60/118,877, filed on Feb. 5, 1999.

(51) Int. Cl.[7] ..... A47H 1/10

(52) U.S. Cl. ..... 248/322; 248/320; 248/332; 248/343; 248/521; 47/67

(58) Field of Search ..... 248/343, 320, 248/322, 332, 327, 339, 521, 323, 324; 47/67

(56) References Cited

U.S. PATENT DOCUMENTS

| | | | | | |
|---|---|---|---|---|---|
| 335,654 | A | * | 2/1886 | Taplin | 248/332 |
| 2,017,625 | A | * | 10/1935 | Kellems | 248/62 X |
| 2,766,501 | A | * | 10/1956 | Kellems | 248/62 X |
| 3,033,502 | A | * | 5/1962 | Silver | 248/156 X |
| 3,883,102 | A | * | 5/1975 | Trigg | 248/156 X |
| 4,078,753 | A | * | 3/1978 | Cole | 248/302 X |
| 4,289,310 | A | * | 9/1981 | Weakly | |
| 4,349,172 | A | * | 9/1982 | Banks, Jr. | 248/322 X |
| 4,571,882 | A | | 2/1986 | Capen | |
| 4,699,347 | A | | 10/1987 | Kuhnley | |
| 4,875,653 | A | * | 10/1989 | Connolly | 248/332 |
| 4,889,309 | A | | 12/1989 | McCure | |
| 4,890,008 | A | | 12/1989 | Chu | |
| 4,913,395 | A | | 4/1990 | Juhas | |
| 5,647,569 | A | | 7/1997 | Sofy | |
| 5,845,890 | A | | 12/1998 | Earsley et al. | |
| 5,878,989 | A | | 3/1999 | Allman | |
| 5,921,022 | A | | 7/1999 | Baker | |
| 5,967,481 | A | * | 10/1999 | Lobo | |
| 5,967,482 | A | | 10/1999 | Holod, Jr. | |
| 5,979,859 | A | | 11/1999 | Vartanov et al. | |
| 6,019,341 | A | | 2/2000 | Brown et al. | |

* cited by examiner

*Primary Examiner*—Korie Chan
(74) *Attorney, Agent, or Firm*—Patterson, Thuente, Skaar & Christensen, P.A.

(57) ABSTRACT

A system of suspending a tree includes a hook secured to an overhead support such as a ceiling joist or beam or structure dedicated to this purpose. A swivel is then secured to the hook. A tree grip is secured to the swivel and then to the main leader of the Christmas tree. The tree will then hang plumb due to the force of gravity. Optionally, a pulley may be employed to assist in the raising of the tree. The pulley is secured to the hook by a loop. The tree grip is secured to the top of the tree. A cable is securely attached to the trunk of the tree below the apex of the tree. The cable is threaded through the sheave of the pulley and may be pulled to raise the tree until the tree grip can be attached to the hook. The free end of the cable may then be attached to the trunk of the tree to provide additional security of attachment.

17 Claims, 2 Drawing Sheets

SYSTEM AND METHOD FOR SUSPENDING A TREE

RELATED APPLICATIONS

This application claims the benefit of Provisional Application No. 60/118,877 filed Feb. 5, 1999, which is incorporated herein in its entirety by reference.

FIELD OF THE INVENTION

The invention relates to the field of Christmas tree stands. More particularly to suspending a Christmas tree from an overhead support and optionally rotating the tree.

BACKGROUND OF THE INVENTION

Christmas tree stands are well known. They generally comprise a means for gripping the base of the tree and a stand base to provide a wide enough stance to hold the tree in an upright position. All such stands suffer from the shortfall of being unable to adequately support a tree which has a trunk that is substantially off center or that is not substantially straight. In such a case a vertical line from the center of gravity of the tree may fall within but near or outside the radius of the base of the tree stand. Thus, the tree may be unstable or even impossible to stand upright. The problem of a tree decorated with delicate ornaments falling over is readily apparent. In addition, a pleasingly shaped tree with bowed or irregular trunk may be impossible to position in a stand without having an appearance of being crooked or tilted.

A variety of Christmas tree stands that attempt to deal with the problem of a non-straight trunk have generally taken the form of a stand which grips the base of the tree trunk and provides a lockable swivel or gimbals which allow the tree to be oriented vertically and then secured in position. For example, U.S. Pat. No. 4,156,323 to Scheffler describes a "cup-shaped holder that may be inclined with respect to vertical to permit proper positioning of the tree and to compensate for irregularities in the tree shape." U.S. Pat. No. 4,571,882 to Capen describes a "hemispherical ball which is received by two adjustable jaws which form a hemispheric cavity. " Another example is U.S. Pat. No. 4,889,309 to McCure which describes a three-legged base with three length adjustable guys to straighten the tree. U.S. Pat. Nos. 4,699,347 to Kuhnley, 4,913,395 to Juhas, 5,845,890 to Earsley et al, and 6,019,341 to Brown et al disclose variations on these themes. All of these still hold the tree at the base and may be unstable if the tree deviates from straight.

Stands designed to rotate a tree about a vertical axis already exist in the art. An example is disclosed is U.S. Pat. No. 4,890,008 to Chu which discloses a stand which alternates in direction of rotation at the end of each full circuit to prevent the twisting of electrical cords that may be attached to lighted ornaments on the tree. U.S. Pat. No. 5,647,569 to Sofy discloses a rotating stand assembly that includes a clutch which can disengage if motion is obstructed and electrical outlets that rotate in concert with the tree. U.S. Pat. No. 5,878,989 to Allman reveals a tree stand which combines rotation, a built in musical unit, a rotating electrical outlet and a remote control for controlling the operation of the tree stand. U.S. Pat. Nos. 5,921,022 to Baker and 5,979,859 to Vartanov et al disclose stands that include rotating electrical outlets along with other feature s. All of these tree stands support the tree from the base. Thus, the problem of an unstable or marginally tree may be magnified by the addition of rotational motion, increasing the likelihood of the tree toppling.

U.S. Pat. No. 5,967,482 to Holod discloses a "Support system for Christmas trees and the like" which discloses an overhead anchor and a clamp connected to a portion of the tree. The clamp disclosed comprises a disposable ratchet mechanism similar to that used in common wire ties. The tree is thus gripped in a way that concentrates stress in a small area of the main leader. This increases the likelihood that breakage may occur and that the tree may fall unless otherwise supported. Since a decorated live tree combines electricity, water and a potential source of fuel for a fire it is essential that the tree be supported in a secure fashion.

The present invention provides a means by which to support a tree securely, in an aesthetically pleasing manner, with no concern of toppling and allows for the safe rotation of the tree if desired.

SUMMARY OF THE INVENTION

The invention allows for the suspension of a Christmas tree from an overhead support. This approach assures a visually pleasing, structurally secure and balanced presentation of the decorated tree.

This is achieved by securing a hook to an overhead support such as a ceiling joist or beam or structure dedicated to this purpose. A swivel is then secured to the hook. A tree grip is secured to the swivel and then to the main leader of the Christmas tree. The tree will then hang plumb due to the force of gravity. Optionally, a pulley may be employed to assist in the raising of the tree. The pulley is secured to the hook by a loop. The tree grip is secured to the top of the tree. A cable is securely attached to the trunk of the tree below the apex of the tree. The cable is threaded through the sheave of the pulley and may be pulled to raise the tree until the tree grip can be attached to the hook. The free end of the cable may then be attached to the trunk of the tree to provide additional security of attachment.

The tree grip comprises a Kellems style mesh grip which is well known in the electrical arts as a device for pulling or supporting electrical cable. This assures a firm grip upon the leader of the tree and that the stress of supporting the weight of the tree is distributed over a large area greatly decreasing the risk of breakage and subsequent collapse of the tree.

In order to stabilize the tree from excessive swinging, the base of the tree may be placed in an open topped basin, which may also be used to store water to provide for the moisture needs of a living tree. The water may also serve to provide additional weight to stabilize the base of the tree.

Since substantially all of the weight of the tree is born by the overhead support, the option of rotating the tree to display all of its sides to the viewer is much simplified. A motorized rotating device to turn the tree trunk is secured to the tree and to the stabilizing and water holding basin. This device may also provide for the supply of electrical power to the lights of the tree. Electrical outlets may be located on the shroud of the rotating device, which rotates with the tree. Thus, twisting of the electrical cords is eliminated. Electrical power to the rotating device may be provided through a brush and ring assembly well known within the electrical arts. Of course, other techniques may be used without departing from the essential attributes of the invention.

DETAILED DESCRIPTION OF THE INVENTION

The invention comprises a system for safely, securely suspending a Christmas tree from above and optionally rotating the tree about a vertical axis in order to display all sides of the tree to the viewer. This provides the additional advantage of easing the decoration process by allowing access to all sides of the tree.

Figure 1:
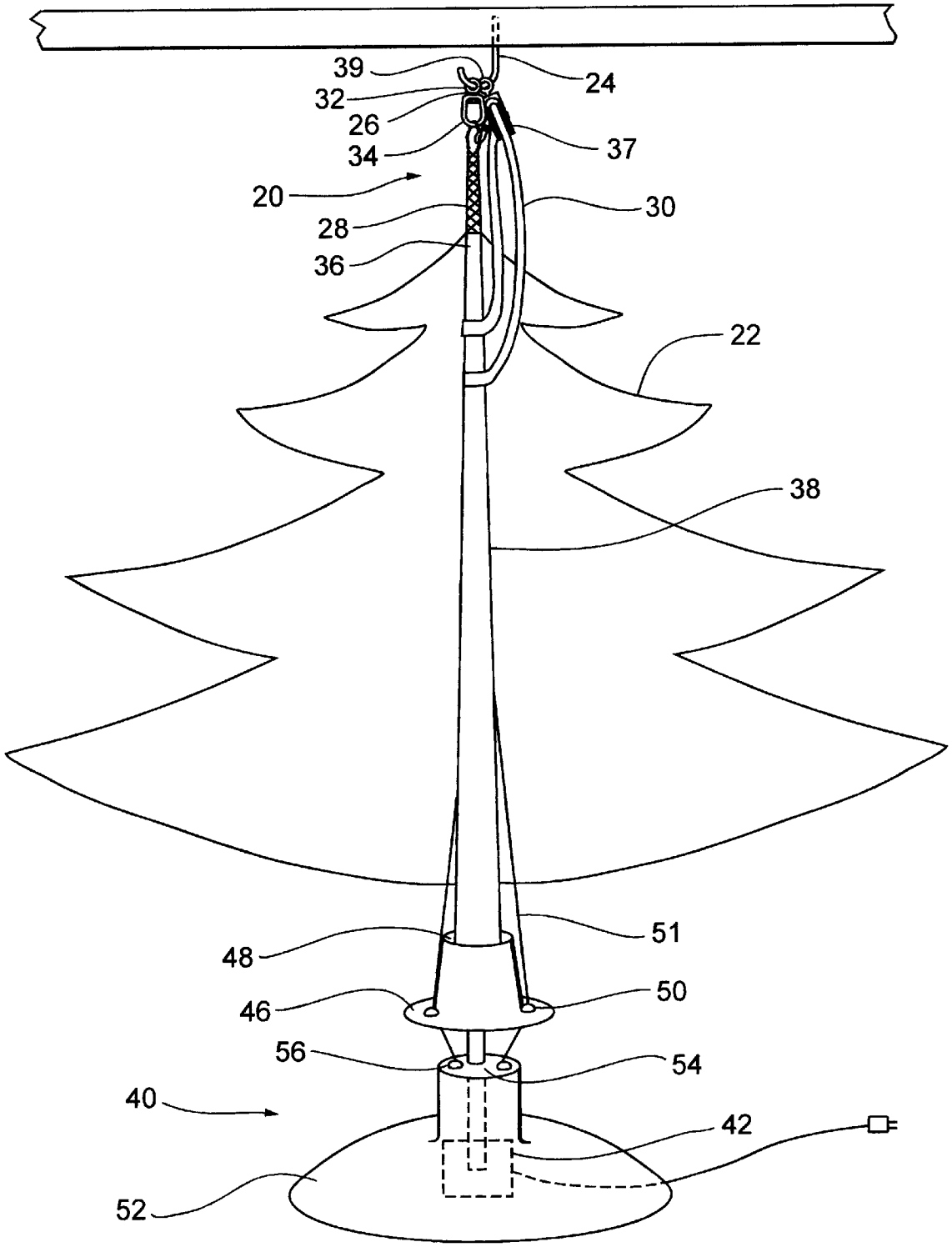
FIG. 1 depicts a system for suspending a tree and also depicts a system for turning a suspended tree.
Figure 2:
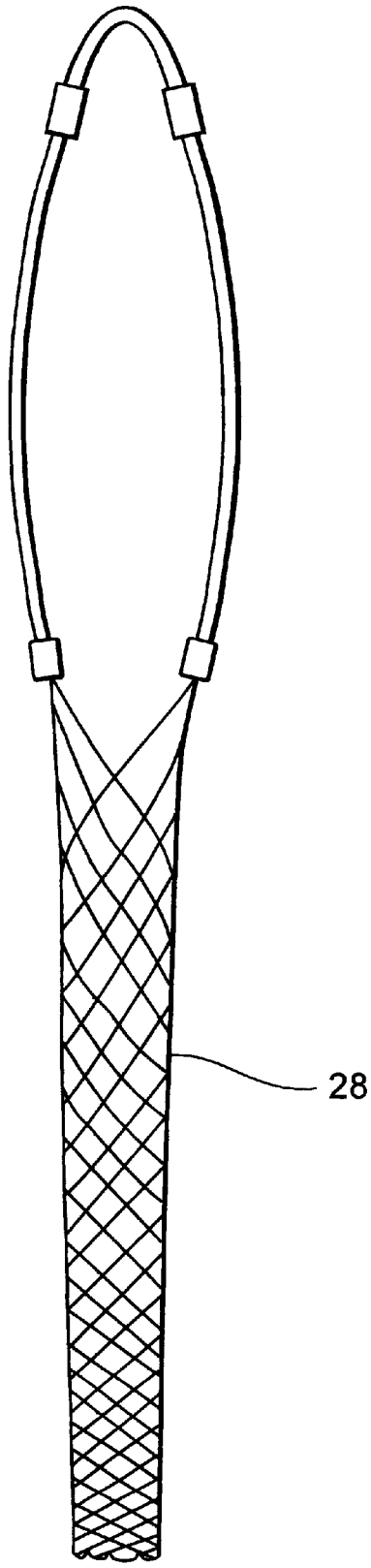
FIG. 2 depicts a Kellem style mesh grip in detail.

Referring to FIG. 1, a system 20 for supporting a Christmas tree 22 is shown. System 20 generally includes a hook 24, a swivel 26, a tree grip 28 and a cable 30.

Hook 24 is preferably like that sold by the H.B. Ives company of Michigan City, Ind. and is capable of supporting up to 300 pounds. Swivel 26 is provided with a top loop 32 and a bottom loop 34. Bottom loop 34 is configured so as to turn and/or swivel about below top loop 32, e.g. such as by ball bearing or swivel joint. Top loop 32 is of sufficient diameter to be placed over and supported by hook 24. Bottom loop 34 is preferably secured to tree grip 28. Tree grip 28 is preferably a metal mesh grip like that sold by Kellems of Stonington, Connecticut. Tree grip 28 may be painted to match the color of tree 22. Cable 30 is also preferably secured to tree grip 28 and is also preferably of a color reflective of the color of tree 22. Cable 30 is preferably a ⅜-inch cord, approximately 10 or more feet in length. As with hook 24, swivel 26, tree grip 28 and cable 30 are preferably designed to hold up to 300 pounds. In addition, a length adjusting device (not shown) may be interposed between the swivel and the tree grip or between the hook and the swivel to adjust the vertical position of the supported tree.

The preferred tree grip comprises a Kellems style wire mesh grip. These grips or pulling tools are commonly used for drawing, holding or supporting electrical cables and have been successfully used for over half a century. They are generally comprised of a braided open wire mesh sleeve formed from interwoven metallic wire strands which may expand radially by longitudinal compression to readily receive the structure to be gripped and radially contracted by longitudinal stretching to frictionally engage the structure to be gripped. They may also be woven from nylon monofilament or other types of fibers. A loop at the end of the grip is provided so that a pulling force may be applied parallel to the long axis of the mesh grip and structure being pulled or supported. Forces applied in this way cause the diameter of the mesh grip to constrict causing a firmer grip to be applied.

Mesh grips are commonly constructed of galvanized steel wire woven in a double spiral fashion one spiral being opposite in twist to the other. The ends of the wire members are secured and connected to a pulling loop or ring by swaged lugs made of a malleable metal, such as copper or aluminum.

To use system 20, hook 24 is preferably mounted to a ceiling joist (not shown) but may be secured to any overhead support of sufficient strength. Swivel 26 and cable 30 are secured to tree grip 28. Tree grip 28 is then compressed, preferably placed over a dominant leader branch 36 of tree 22, and pulled taut such that tree grip 28 grabs tightly to branch 36. A pulley 37, that is provided with a hanging loop 39, is threaded with cable 30. The hanging loop is then placed on hook 24 and cable 30 is pulled downward raising tree 22 upward. Tree 22 is raised upward until top loop 32 is in position to be placed over hook 24. Tree 22 is then pushed slightly so that top loop 32 engages hook 24. The pulley is left in position on hook 24 and cable 30 is tied tight to the trunk 38 of tree 22 to provide additional security that tree 22 will remain on hook 24 either by top loop 32 or by the pulley and cable 30. In the event that the tree is to be rotated or a rotating device is to be used the cable may be removed from the pulley and rethreaded through the bottom loop 34 of the swivel and then tied securely or otherwise secured to the tree trunk. This will prevent cable 30 from twisting as the tree rotates. Tree 22 is now suspended from hook 24, the weight of tree 22 causing it to hang substantially vertical and straight, and behaving in effect like a plumb line. Tree 22 may now be turned for lighting and decorating allowing the user to stand in a single position rather than walking around the tree 22. Once lighting and decorating are finished, tree 22 may be turned to present its most attractive side. A water basin and/or tree stand may then be provided under the trunk 38 of tree 22 to stabilize the tree's position and provide water if necessary. Note that a tree top decoration, e.g. star or angel, may be affixed to the top of tree grip 28 so that the decoration may still be present at the top of tree 22.

System 20 may be used alone or in combination with a motorized turning (or rotating) system 40. Motorized turning system 40 generally includes a motor 42, an adjustable shaft 44 and a basin 46. Motor 42 is preferably a motor made by H.M.S. Mfg. Company of Troy, Mich. Shaft 44 is operably coupled to motor 42 and is preferably adjustable in length. Shaft 44 is also operably coupled to basin 46. Basin 46 provides a well 48 where the trunk 38 of tree 22 may be inserted. Screws (not shown) near the top of well 48 are turned into the trunk 38 of tree 22 and secure basin 46 to tree 22. Well 48 is designed to hold water if necessary for watering a live tree. Basin 46 is provided with a plurality of holes 50 through which electrical cords 51 from Christmas tree lights may be passed. A shroud 52 is preferably provided to cover motor 42 and provide a platform 54 where electrical outlets 56 may be conveniently mounted. Such a rotating device is disclosed in U.S. Pat. No. 5,647,569 to Sofy which is incorporated herein by reference.

When using system 20 with motorized turning system 40, tree 22 is first suspended using system 20, as described above. Then motorized turning system 40 is moved beneath the trunk 38 of tree 22, motor 42 resting on the floor (not shown). Once in position below tree 22, the length of shaft 44 is adjusted to position basin 46 appropriately to the trunk 38 of tree 22 so that tree 22 may receive water from well 48, if necessary, and so that tree 22 may be secured to basin 46 with the screws. Tree light electrical cords 51 may then be passed through holes 50 and plugged into outlets 56. Note that basin 46 and platform 54 rotate with shaft 44 preventing winding of electrical cords 51. Power may now be supplied to motor 42 and electrical outlets 56 allowing lighted tree 22 to continuously revolve and present all sides of the decorated tree. It should be noted that while system 20 supports substantially all weight that would otherwise be bearing down on motorized turning system 20, the manner in which the weight of tree 22 is distributed does have some impact on the operation of motor 42. For example, in the instance of a live tree, the weight of tree 22 is not evenly distributed and, as such, the speed of motor 42 may alter slightly during rotation. In the instance of an artificial tree, the weight of tree 22 is usually evenly distributed and alterations in the speed of motor 42 do not occur.

As an alternative to the combination of hook 24, swivel 26 and the pulley described above, a single unit incorporating all of these features may be used. The single unit includes a unique hook with a ball bearing swivel and an access for a cord to pull tree 22 into position.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed:

1. A tree suspension system for suspending a Christmas tree from an overhead support, wherein said tree has an upper end, the system comprising:

a hook that is capable of engaging said overhead support;

a swivel attachable to said hook, wherein the swivel has a top loop and a bottom loop that are capable of unlimited rotation with respect to each other; and a wire mesh tree grip attachable to said swivel and attachable to said upper end of said tree such that said tree grip is rotatable with respect to said hook for rotatably suspending the tree from the hook.

2. The tree suspension system of claim 1, wherein said wire mesh tree grip comprises a braided open wire mesh sleeve, having a length, which is configured to radially expand upon compression of said length and to radially contract upon extension of said length to grip an upper main leader of said tree.

3. The tree suspension system of claim 1, further comprising a pulley system attachable to said hook and to said tree, wherein said pulley system is usable to raise said tree and position said swivel proximate said hook.

4. The tree suspension system of claim 1, further comprising a basin, wherein said basin stabilizes a base of said Christmas tree and provides a water storage space.

5. The tree suspension system of claim 4, the basin further comprising a motorized rotating device that is attachable to said base of said tree.

6. The tree suspension system of claim 5, in which said motorized rotating device includes a plurality of electrical outlets.

7. A method of suspending a Christmas tree from an overhead support, the method comprising:

gripping a branch of a Christmas tree with a wire mesh tree grip;

securing said tree grip to a swivel, wherein the swivel has a top loop and a bottom loop that are capable of unlimited rotation with respect to each other;

lifting said Christmas tree; and suspending said Christmas tree by positioning said swivel over a hook, wherein said hook is attachable to said overhead support, and wherein said tree is rotatable with respect to said hook.

8. The method of claim 7, wherein said mesh tree grip comprises a braided open wire mesh sleeve, having a length, which is configured to radially expand upon compression of said length and to radially contract upon extension of said length to grip an upper main leader of said tree and wherein gripping the Christmas tree includes radially contracting the wire mesh.

9. The method of claim 7, wherein said step of lifting is performed with the aid of a pulley system.

10. The method of claim 9, wherein said pulley system includes a pulley that is suspended from said hook and wherein lifting the Christmas tree includes lifting a hanging loop, the hanging loop passed through the pulley.

11. The method of claim 7, further comprising the step of: placing a base of said Christmas tree into an open top basin configured to stabilize said Christmas tree.

12. The method of claim 11, further comprising the steps of: securing a motorized rotating device to a base of said Christmas tree and to said basin.

13. The method of claim 12, in which said motorized rotating device includes a plurality of electrical outlets, the method further comprising connecting the electric outlets to a source of electricity.

14. A system for supporting a Christmas tree from an overhead support, wherein said tree has an upper end, the system comprising:

a hook that is capable of engaging said overhead support;

a swivel having an upper portion and a lower portion, wherein said upper portion is capable of unlimited rotation with respect to said lower portion, and wherein said upper portion is removably positionable over said hook; and a mesh tree grip, wherein said mesh tree grip is removably securable to said lower portion of said swivel and wherein said mesh tree grip grips a branch of said Christmas tree for rotatably suspending the tree from the hook.

15. The system of claim 14, further comprising a pulley system attachable between said hook and said mesh tree grip.

16. The system of claim 15, wherein said pulley system is usable to lift said Christmas tree to position said swivel proximate said hook.

17. The system of claim 14, further comprising a motorized rotating system that is securable to a base of said Christmas tree.

* * * * *